United States Patent [19]

Zabielski

[11] Patent Number: 4,927,350

[45] Date of Patent: May 22, 1990

[54] COMBUSTION CONTROL

[75] Inventor: Martin E. Zabielski, Manchester, Conn.

[73] Assignee: United Technologies Corporation, Hartford, Conn.

[21] Appl. No.: 43,571

[22] Filed: Apr. 27, 1987

[51] Int. Cl.[5] ..... F23N 1/00

[52] U.S. Cl. ..... 431/12; 431/79

[58] Field of Search ..... 431/6, 12, 76, 79

[56] References Cited

U.S. PATENT DOCUMENTS

| | | | |
|---|---|---|---|
| 3,988,104 | 10/1976 | Barber | 431/79 |
| 4,043,742 | 8/1977 | Egan et al. | 431/12 |
| 4,410,266 | 10/1983 | Seider | 431/79 |
| 4,435,149 | 3/1984 | Astheimer | 431/79 |
| 4,576,570 | 3/1986 | Adams et al. | 431/76 |
| 4,586,893 | 5/1986 | Somerville et al. | 431/76 |

*Primary Examiner*—Carroll B. Dority

*Attorney, Agent, or Firm*—Edward L. Kochey, Jr.

[57] ABSTRACT

At various loads a fuel/air peak relationship is determined for the peak infrared radiation. A desired operating fuel/air ratio is determined as is the offset between the relationship and the ratio. Later recalibration of the control system is established by determining a new fuel/air peak relationship and applying the offset.

8 Claims, 1 Drawing Sheet

COMBUSTION CONTROL

TECHNICAL FIELD

The invention relates to combustion processes and in particular to a method of recalibrating a process which is operated with feed forward fuel/air ratio control.

Feed forward controls rely on the ratio of inputs without any feedback modification based on the results of the inputs. For instance, a fuel valve may be set to determine a desired load, with or without feedback while the air damper may be set at a particular position in response to the fuel valve position. Therefore the fuel/air ratio has no feedback aspects.

Feedback systems rely on a measured result to modify the inputs. Such systems are relatively expensive, require maintenance, and must always be in service. In some cases the result of the inputs may not be easy to measure on a continuing basis.

In dealing with a fuel/air ratio a conventional feedback system would use oxygen in the flue gas to modify the fuel inputs to the burners. This may be distorted by air leakage into the furnace through casing leaks or doors which may be left open. Accordingly it may not always be a accurate picture of the conditions at the burner. Where multiple burners exist the single feedback from the flue gas cannot differentiate between the operating condition of the various burners. Where a reducing atmosphere is used such as in a gasifier or in a heat treating furnace requiring a reducing atmosphere, the feedback signal is not easy to obtain.

Feed forward signals experience a few different difficulties. A change in heating value of the fuel will upset the control system. Also, wear or buildup in the input nozzles can change the actual input with relation to the setting of the input device, thereby introducing error.

It therefore would be desirable to have an inexpensive feed forward system which may be easily recalibrated either periodically or whenever a change in conditions is suspected.

DISCLOSURE OF THE INVENTION

A combustion process such as in a steam generator is operated on a feed forward basis where fuel set to obtain a desired load and the airflow damper is set in a position relative to the position of the fuel valve. An initial calibration is made determining the offset position of the linkage connecting the air and fuel means between the desired operating condition and the stoichiometric condition.

At each of a plurality of load conditions fuel is held constant while the air is varied to a plurality of said positions. The infrared radiation from the flame is measured for each of the airflow conditions. At each condition the fuel flow is slightly modulated to produce a pulsation in the flame at the known frequency of the modulation. The infrared radiation from the flame is sensed and filtered to accept only the frequencies of the modulation, thereby filtering out most of the background radiation. After the radiation signals from the plurality of airflow positions are obtained a cubic curve is generated from the data and the peak of the curve is located, this representing the peak infrared radiation of the flame. The position of the airflow damper in respect to the fuel valve is also identified at this location.

At the same load the desired airflow ratio is determined based on any resultant condition of the airflow desired, such as oxygen concentration in the stack. The airflow damper position is noted for this position and the offset between the stoichiometric position and the desired position is noted and recorded.

This is repeated at a plurality of load conditions with the offset determined at each load. Further operation of the unit is based on interpolation between the known positions to maintain the relationship between the fuel valve and the air valve in the desired relationship.

When it is desired to recalibrate the system, the location of the infrared radiation peak is again determined. This may be at a different location than before because of variations in the heating value of the fuel or where there is pluggage of the equipment. The entire earlier operation requiring determination of the results of the fuel/air input need not again be carried out. The known offset between the peak radiation and the desired condition is applied to the new peak condition, thereby obtaining new operating conditions. The unit is thereafter operated based on these new conditions.

BEST MODE FOR CARRYING OUT THE INVENTION

Figure 1:
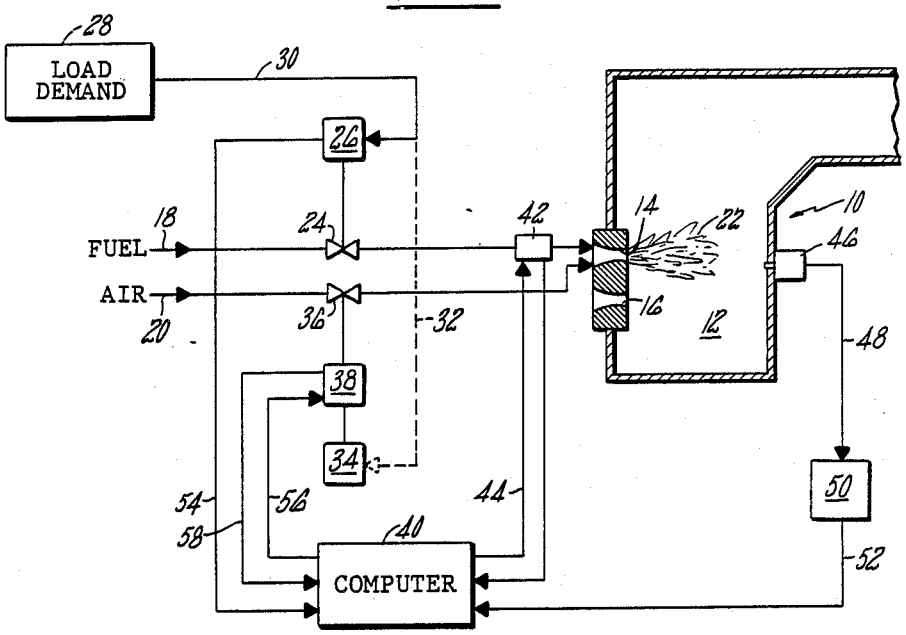
FIG. 1 is a schematic diagram of the control system applied to a boiler.

In FIG. 1 there is illustrated a boiler 10 having a furnace 12. An upper burner 14 and a lower burner 16 are located in a wall of the steam generator.

A flow of fuel 18 and a flow of air 20 are introduced through burner 14 to produce flame 22 within the furnace.

Fuel control valve 24 driven by actuator 26 operates to regulate the quantity of fuel passing to burner 14. Load demand signal 28 has a signal based on the required steam flow or some other desired output. This signal passes through line 30 to the actuator 26 which sets the position of the fuel valve 24. Dashed line 32 indicates this signal also passing to airflow actuator 34. This may be accomplished by a parallel signal as suggested by the schematic or the same operation may be obtained with a physical linkage connecting the actuator, and accordingly the position indicator, of fuel valve 18 with the actuator 34, which therefore sets the position of airflow damper 36. An adjustor 38, which may be in the form of a length adjustment in a connecting linkage, operates to bias the damper 34 with respect to movement of the actuator 34 as desired.

In a conventional operating system the adjustor 38 would be set at a fixed position, and stay in that position for all loads. In the instant system this adjustor 38 is varied with load as described later.

In the description below the term ratio as in fuel/air ratio is used to signify the actual fuel flow airflow ratio. The term relationship as in fuel/air relationship is used to signify the relative positions of the fuel valve and the air damper without specific recognition of the actual flow passing through each. The term fuel input load is used to designate the required load demand which may be in pounds per hour steam flow from a steam generator, gas flow produced or any other required output from the overall combustion system.

The term fuel/air input peak relationship refers to the physical relationship of the fuel valve and air damper at the peak infrared radiation condition while the term desired fuel/air input relationship relates to the physical fuel valve air damper position at the desired operating condition. The term fuel/air relationship offset relates to the physical difference between the above two relationships.

The term airflow position relates to the physical location of the air damper at any particular time while the term peak position relates to the physical location of the air valve at the peak infrared radiation condition.

Figure 2:
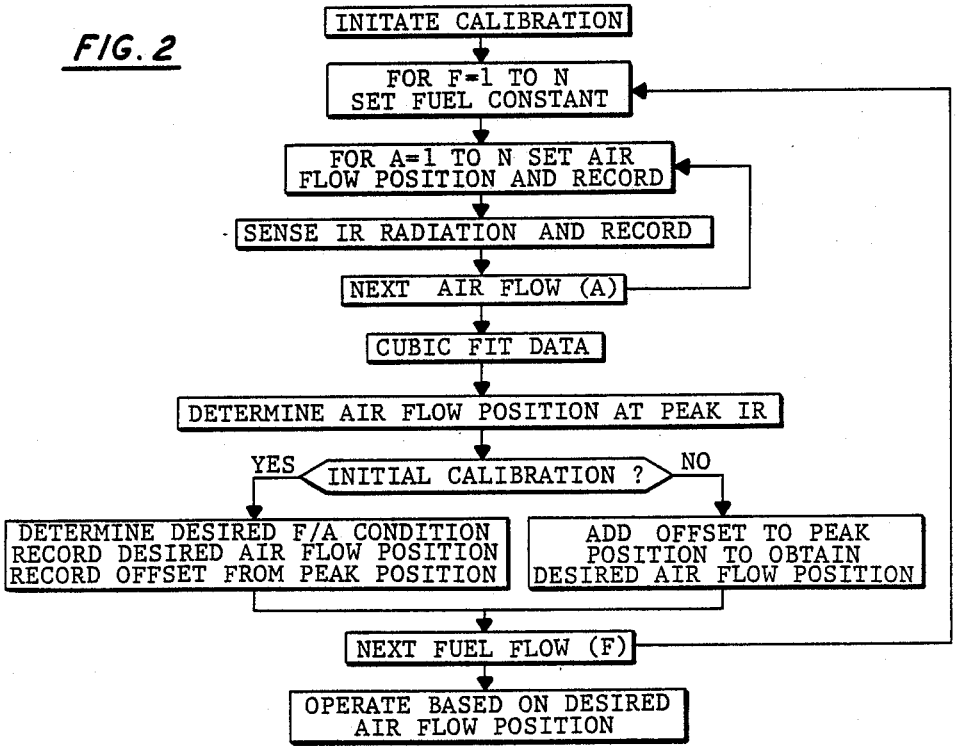
FIG. 2 is a flowchart of the calibration schemes.

While the control system may be used on a fixed fuel flow system it is described in application to a variable load boiler where fuel is adjusted over a significant load range. As indicated on the flowchart of FIG. 2, initiating calibration is started by selecting a first fuel rate such as 25 percent of the full load input. This is held constant and a first airflow position is established. Modulator 42 placed in the fuel flow line includes a butterfly type valve with considerable leakage which may be rotated within the pipe to provide fluctuations in the oil flow. It is sized so as to provide a fluctuation in the order of 1 to 5 percent of the fuel flow. Computer 40 sends a signal to the modulator 42 through control line 44 of 30 Hertz to establish a fuel pulsation of this frequency. This signal is preferably somewhere in the range between 20 and 50 Hertz which successfully avoids interference from conventional flame noise which runs from 0.1 to 10 Hertz.

An infrared detector 46 is located preferably on the opposite wall of the furnace with the lens aimed at and focusing on flame 22. A radiation detector which picks up radiation of 4.3 microns wavelength which is the $CO_2$ range is satisfactory although those that also pick up radiation from water vapor would be acceptable. Independent of any filtering of the radiation, the signal leaving the infrared sensor 46 is essentially an unfiltered signal in that it contains all fluctuations that are seen by the sensor. The unfiltered signal from the infrared sensor passes through line 48 to signal conditioner 50. This signal here is amplified and passed through a 20 Hertz high Q filter to eliminate the majority of radiation that is not consistent with the frequency established by the modulator 42 and the flame 22. Filters from 20 to 30 Hertz would be reasonable. Accordingly the background radiation is substantially cancelled and the signal passing on through line 52 to computer 40 represents only the signal due to the radiation from the flame.

The fuel modulation and the infrared signal should be phase coordinated for proper operation. A rectangular signal produced by a photodetector on the modulator serves as a frequency reference. The period of the reference signal, which is captured asynchronously by the computer and stored in an array, is determined by detecting the leading edge of this signal and then advancing a preset amount of array indices and then detecting the next leading edge. The period of the reference signal is determined by averaging the index differences between successive leading edges. The minimum value in the infrared detector data array is determined and then subtracted from all values in the detector data array. This process removes any offset. Phase matching is accomplished by forcing the minimum of a sine wave, whose period equal to that of the measured reference signal, to coincide with the minimum of the detector signal. The phased sine wave is then multiplied by the infrared detector signal. This product is integrated to produce a number that is directly related to the modulated infrared intensity.

For this initial determination a particular airflow position has been set and accordingly there is a particular position of adjustor 38. This accordingly establishes a fuel/air input relationship which is the physical relationship between the position of fuel valve 24 established by actuator 26 and the airflow damper 36 established by actuator 34 and modified by adjustor 38. This data is stored in an array and a new airflow position is established. The corresponding infrared radiation is sensed and stored. After this is carried out with the same fixed fuel flow and a plurality of airflow conditions the stored data is modified by a cubic fit. The resultant equation is then differentiated and set to zero to find the maximum point of the infrared radiation curve with respect to the airflow damper position.

If this is the initial calibration, the desired fuel/air condition must be obtained. This is accomplished by operating the unit and determining the desired resultant output condition. This may be overall efficiency of the unit, appearance of the flame as viewed by a skilled boiler operator, the extent of a reducing atmosphere, or any other objective which is to be achieved by the system which is a function of the air/fuel ratio. The airflow position and accordingly the desired fuel/air input relationship is determined. This being the physical relationship between the fuel valve and the air damper at this desired condition. The offset or difference between the desired condition and the above determined position at the peak infrared condition is sensed and recorded as the fuel/air relationship offset.

The above described calibration is carried out at 50 percent, 75 percent and 100 percent load to determine the desired operating conditions over the entire load range. In further operation the relative position of the fuel valve and the air damper is adjusted in accordance with the desired fuel air input relationship over the load range by interpolating between the known data.

In carrying this out the computer 40 receives a signal from actuator 26 through control line 54 which is a measure of the fuel valve position. It accordingly sends a signal through control line 56 to position modifier 38 to set the required position of the air damper 36. A signal returning to the computer through control line 58 represents the actual position of the airflow damper 36. After operating at this condition for some time this system may be calibrated either periodically such as once each shift or whenever a change is suspected such as a change in the heating value of the fuel being received by the plant. In such a case the load is again set constant at a plurality of loads and airflow varied with the infrared radiation being sensed as before. There is, however, no need to again go through the operation of determining the desired conditions based on the output from the system. Instead the known offset which was earlier determined is applied to the fuel/air input peak relationship which is newly established. The application of the known fuel/air relationship offset to this new peak relationship results in a new desired fuel/air input relationship. Further operation of the unit continues based on this modified new relationship.

What is claimed is:

1. In a combustion process which is regulated by maintaining a preselected feed forward relationship of fuel input and air input, the improved method of operating comprising:

establishing a fuel/air input peak relationship for the approximately stoichiometric condition which produces the maximum infrared radiation;

selecting a desired operating fuel/air ratio based on a result of the fuel/air input other than infrared radiation;

determining the desired fuel/air input relationship for said desired operating fuel/air ratio;

determining a fuel/air relationship offset between the fuel/air input peak relationship and the fuel/air input desired relationship;

operating the combustion process based on a feed forward signal representing the desired fuel/air input relationship;

recalibrating the process by later establishing a new fuel/air input relationship for the approximately stoichiometric condition which produces the maximum infrared radiation;

establishing a new desired fuel/air relationship by applying said fuel/air relationship offset to the new fuel/air input peak relationship;

operating the combustion process at the new desired fuel/air relationship.

2. The method of claim 1, including:

operating the combustion process at a plurality of fuel input loads;

establishing a fuel/air input peak relationship for the approximately stoichiometric condition which produces the maximum infrared radiation for each of said fuel input loads;

selecting a desired operating fuel/air relationship based on a result of the fuel/air input other than infrared radiation for each of said fuel input load;

determining the desired fuel/air input relationship for said desired operating fuel/air relationship for each of said fuel input loads;

determining a fuel/air relationship offset between the fuel/air input peak relationship and the fuel/air input desired relationship for each of said fuel input loads;

operating the combustion process at any load based on a feed forward signal representing an interpolated signal for the corresponding load of the desired fuel/air input relationship for each of said plurality of loads;

recalibrating the process by later establishing a new fuel/air input relationship for the approximately stoichiometric condition which produces the maximum infrared radiation for each of said fuel input loads;

establishing a new desired fuel/air relationship by applying said fuel/air relationship offset between the new fuel/air input peak relationship and the desired fuel/air input relationship for each of said fuel input loads;

operating the combustion process at the new desired fuel/air relationships.

3. A method as in claim 1, the steps of determining the fuel/air relationship comprising:

positioning an airflow damper in response to a position of a fuel flow valve.

4. A method as in claim 1, the step of establishing a fuel/air input peak relationship including:

holding the fuel flow substantially constant; changing airflow to a plurality of fuel/air ratios;

sensing fuel/air input relationship for each ratio;

sensing the infrared radiation for each ratio; storing rough data representing said fuel/air input relationship and said infrared radiation;

obtaining modified data by fitting said rough data to a cubic curve;

differentiating the cubic curve and determining the peak.

5. A method as in claim 4, the step of sensing input relationship radiation including:

modulating the fuel flow at a known frequency; detecting unfiltered signal of infrared radiation emitted from the flame;

filtering said unfiltered signal with a band accepting said known frequency, whereby the flame emission is separated from background emission.

6. A method as in claim 5:

said known frequency being between 20 and 50 Hertz.

7. The method of claim 1:

the step of selecting a desired operating fuel/air relationship based on a result of the fuel/air input other than infrared radiation comprising, selecting a desired operating fuel/air relationship based on the oxygen concentration in the stack.

8. The method of claim 1:

the step of selecting a desired operating fuel/air relationship based on a result of the fuel/air input other than infrared radiation comprising, selecting a desired operating fuel/air relationship based on the efficiency of the unit.

* * * * *